United States Patent [19]

Kobayashi

[11] Patent Number: 4,798,384

[45] Date of Patent: Jan. 17, 1989

[54] CLUB-HEAD

[75] Inventor: Masashi Kobayashi, Matsudo, Japan

[73] Assignee: Maruman Golf Co., Ltd., Tokyo, Japan

[21] Appl. No.: 55,803

[22] Filed: May 27, 1987

Related U.S. Application Data

[62] Division of Ser. No. 837,981, Mar. 10, 1986, Pat. No. 4,690,408.

[30] Foreign Application Priority Data

Mar. 14, 1985 [JP] Japan ..... 60/49378

[51] Int. Cl.[4] ..... A63B 53/04

[52] U.S. Cl. ..... 273/172; 273/174

[58] Field of Search ..... 273/172, 174, 169, 173, 273/167 H, 170, 171, 175, 167 R, 167 A, 167 B, 167 F, 168

[56] References Cited

U.S. PATENT DOCUMENTS

| | | | |
|---|---|---|---|
| 1,433,744 | 10/1922 | Rhind | 273/172 |
| 1,538,415 | 5/1925 | Tootle | 273/172 |
| 2,014,829 | 9/1935 | Young | 273/174 |
| 2,328,583 | 9/1943 | Reach | 273/174 X |
| 2,705,147 | 3/1955 | Winter | 273/167 H |
| 3,212,783 | 10/1965 | Bradley et al. | 273/173 |
| 3,250,536 | 5/1966 | Moser | 273/169 X |
| 4,630,825 | 12/1986 | Schmidt et al. | 273/174 |
| 4,690,408 | 9/1987 | Kobayashi | 273/172 X |

*Primary Examiner*—George J. Marlo

*Attorney, Agent, or Firm*—Armstrong, Nikaido Marmelstein & Kubovcik

[57] ABSTRACT

A club-head (11) for an iron golf club in which the outer shell (13) and core body (14) of the club-head are formed of metals having a different specific weight from each other. The weight of the embedded core body is concentrated at the center of the hitting portion of the club head. This allows an improvement in the weight distribution and disposition of the center of gravity of the club-head (11), and since the outer shell (13) is made of a metal, prevents scratching and cracking of the surface of the outer shell (13).

3 Claims, 3 Drawing Sheets

CLUB-HEAD

This is a division of application Ser. No. 837,981, filed on Mar. 10, 1986, now U.S. Pat. No. 4,690,408.

BACKGROUND OF THE INVENTION

1. Field of the Invention

The present invention relates to a club-head for a golf club, particularly to an improvement of a club-head for a metal golf club.

2. Description of Related Arts

A number of proposals have been made for improvements to a metal golf club such as an iron by adjusting the position of the center of gravity of the club-head or improving the distribution of weight thereof by, for example, manufacturing a club-head having a hollow structure or forming irregular portions on the surface thereof. However, a hollow structure of a club-head tends to degrade of the strength of the head, and the formation of an irregular surface mars the aesthetic appearance thereof.

Recently, a club-head comprising a metallic core body covered with an outer shell made of a fiber-reinforced plastic has become popular. This type of club-head, however, has a drawback in that the surface of the outer shell of fiber-reinforced plastic is easily damaged by scratches during use, or even when in a carrying case, and in that the fiber-reinforced plastic is liable to crack and break off at the time of impact with a golf ball.

SUMMARY OF THE INVENTION

Accordingly, it is an object of the present invention to provide a club-head having a simple shape satisfying the aesthetic sense of the user, and having a good resistance against scratching and breakage, which can be manufactured so that the position of the center of gravity and distribution of weight are selected at will.

The above object of the present invention is achieved by a club-head made of metal and comprising two elements; an outer shell and a core body embedded in the outer shell, the metals composing these two elements having a different specific weight from each other.

Preferably, the weight of the core body is distributed substantially in the area of a periphery of a hitting portion of the club-head. Advantageously, the core body has at least a rib located in the hitting portion, and desirably, the weight of the core body is substantially concentrated in a central area of the hitting portion.

In another aspect of the present invention, part of the core body may be exposed outside of the outer shell in the sole of the club-head.

BRIEF DESCRIPTION OF THE DRAWINGS

Other and further objects and advantages of the present invention will be apparent from the following description with reference to the preferred embodiments illustrated in the drawings; wherein.

DESCRIPTION OF THE PREFERRED EMBODIMENTS

Figure 1:
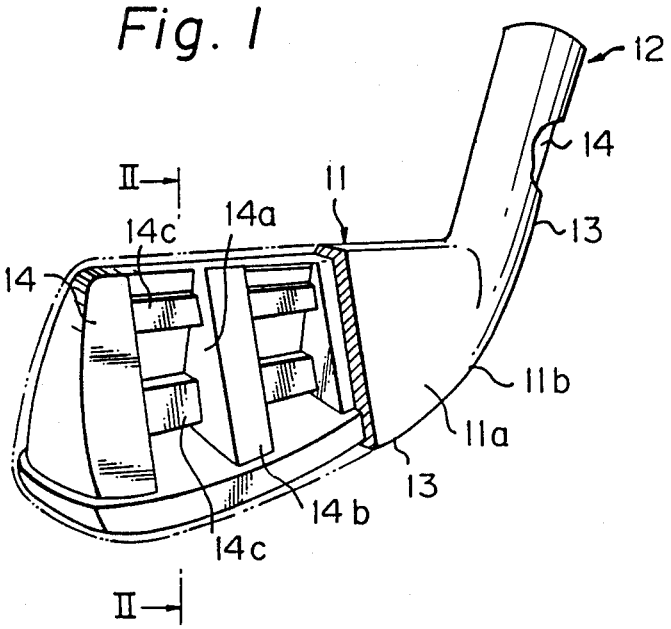
FIG. 1 is a partial broken perspective view of a head of an iron golf club according to a first embodiment of the present invention.
Figure 2:
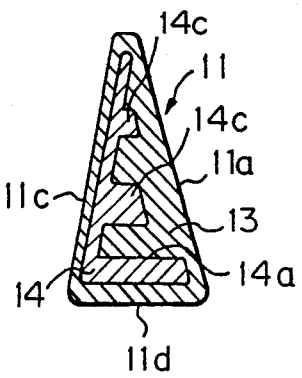
FIG. 2 is a section taken along a line II—II of FIG. 1.

FIGS. 1 and 2 illustrate a first embodiment of the present invention applied to a club-head for an iron golf club. As apparent from the drawings, the club-head comprises a hitting portion 11 having a face 11*a*, and a neck 12 extending obliquely upward from a heel 11*b* of the hitting portion 11. As shown in FIG. 2, the hitting portion 11 has a substantially triangular cross section formed by the face 11*a*, a back face 11*c* opposite to the face 11*a*, and a sole 11*d*.

The hitting portion 11 and the neck 12 are together constituted by an outer shell 13 and a core body 14 embedded in the interior of the outer shell 13. The outer shell 13 envelopes the entire surface of the core body 14. The two elements 13 and 14 are made of the respective metals having different specific weights; in this case, the metal composing the outer shell 13 has a smaller specific weight than that of the metal of the core body 14. For example, the smaller specific weight metal may be an alloy of aluminum, magnesium or titanium, and the larger specific weight metal may be stainless steel, iron, copper or brass.

According to this embodiment, a plurality of grooves 14*a* are provided in an area on the core body 14 to be disposed in the hitting portion 11 of the club-head. The grooves 14*a* are formed by two lateral ribs 14*c* sectioned by a vertical rib 14*b*. In this case, the groove 14*a* is opened toward the face 11*a* and closed at the back of the head; however, the opening of the groove 14*a* may face any side.

Figure 3:
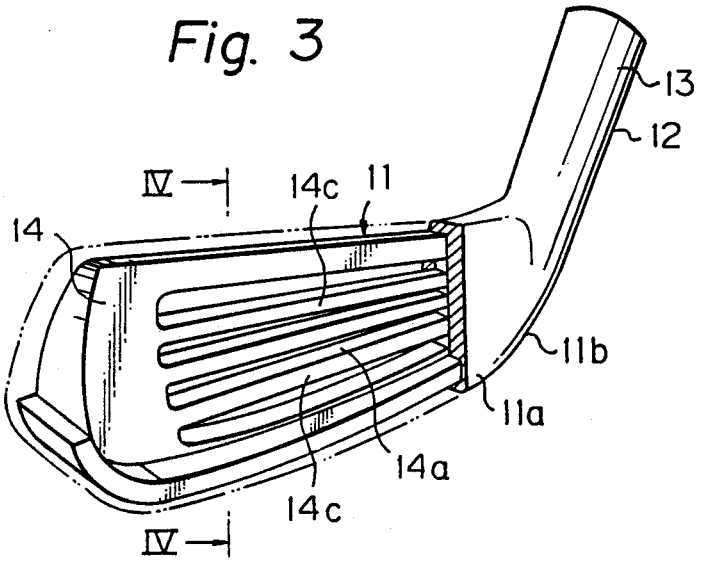
FIG. 3 is a partial broken perspective view of a head of an iron golf club according to a second embodiment of the present invention.
Figure 4:
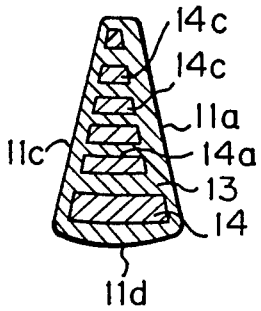
FIG. 4 is a section taken along a line IV—IV of FIG. 3.

FIGS. 3 and 4 illustrate a second embodiment according to the present invention applied to a club-head for an iron golf club, in which the same reference numerals as used in FIGS. 1 and 2 are used for designating the identical or corresponding parts.

The club-head of the second embodiment comprises an outer shell 13 and a core body 14, formed of the same metals as in the case of the first embodiment. A plurality of apertures 14*a* are provided in the hitting portion 11 on the core body 14, which apertures extend in the lateral direction and are bored through from the face side to the back of the hitting portion. The respective apertures 14*a* are separated from each other by a lateral rib 14*c*. Other constituents are identical to the first embodiment shown in FIGS. 1 and 2 except for the elimination of the vertical rib 14*b*. According to these two embodiments of the present invention, the weight of the core body 14 is distributed in the peripheral area of the hitting portion 11 of the club-head when it has been incorporated in the club-head, whereby the moment of inertia of the club-head about the center of gravity is increased.

Figure 5:
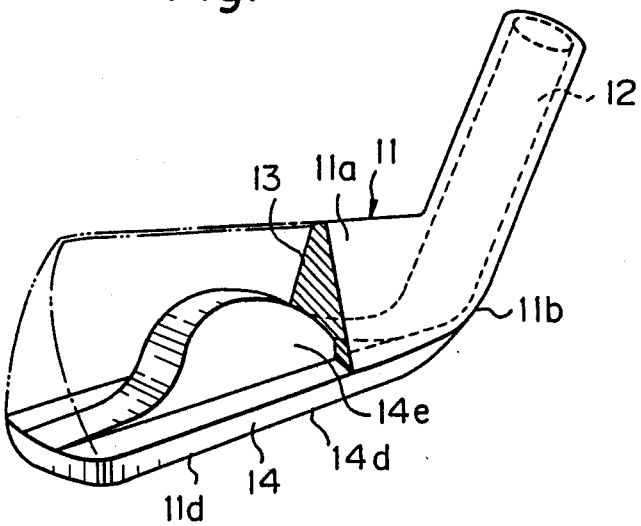
FIG. 5 is a partial broken perspective view of a head of an iron golf club according to the present invention.

FIG. 5 illustrates a third embodiment of the present invention, in which the same references are again used for indicating the identical or corresponding parts as in the foregoing embodiments. The club-head of this case also comprises an outer shell 13 and a core body 14, each being formed of the same metals as utilized in the first embodiment. A feature particular to this embodiment is that part of the core body 14 is exposed in the sole 11*d* of the hitting portion 11, and the other part thereof is enveloped by the outer shell 13. The core body 14 comprises an elongated plate 14*d* extending along the sole 11*d* when the former has been incorporated in the club-head, and a protrusion 14*e* projected upward from the innerside of the elongated plate 14*d*. The protrusion 14*e* is embedded in the club-head by the outer shell 13.

According to this third embodiment, the weight of the club-head is on one side of the area in the vicinity of the sole 11*d* and, further, is concentrated substantially in the neighbourhood of the center of gravity of the club-head, which is thought to be desirable for a club for more experienced golfers.

Figure 6:
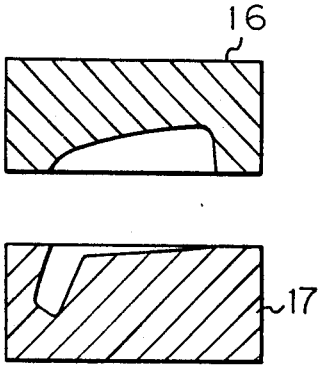
FIGS. 6 through 8 are sections of a mold for a club-head illustrating steps of manufacturing the club-head.
Figure 7:
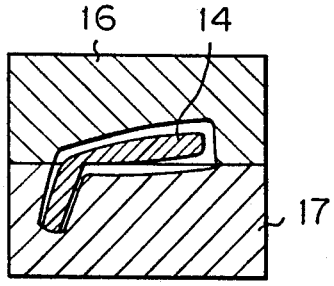
Figure 8:
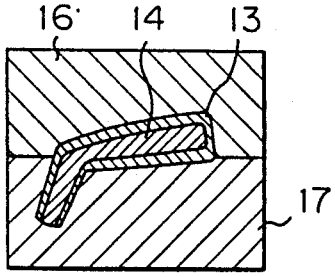

This club-head can be made by a conventional casting process. That is, the core body 14 may be formed by a lost wax process, casting, or die casting, and the outer shell 13 may be molded by casting or die casting so as to incorporate the core body 14 therein. One example of the manufacturing process for the club-head according to the present invention is diagrammatically illustrated in FIGS. 6 through 8. A pair of molds 16, 17 are prepared as shown in FIG. 6. A preliminarily prepared core body 14 is disposed within a cavity formed between the molds 16, 17 as shown in FIG. 7, then a molten metal for the outer shell 13 is poured into and fills the cavity, whereby the integration of the core body 14 with the outer shell 13 is completed.

As apparent from the above description, the club-head can be made as a solid head having no cavity therein, which prevents degradation of the strength of the club-head. The possibility of shaping the core body in various forms enables an improvement of the weight distribution and the disposition of the center of gravity of the club-head to any extent, without the provision of an irregular surface on the outer shell. Since the outer shell is formed of a metal, the surface thereof has a superior resistance to damage such as scratching or cracking, compared to an outer shell formed of a fiber-reinforced plastic.

While particular embodiments and applications of the present invention have been shown, it will be understood, of course, that the present invention is not limited thereto, since modifications can be made by those skilled in the art in the light of the foregoing teachings. For example, the outer shell may be formed of a heavier metal, and conversely, the core body may be formed of a lighter metal. Further, the present invention may be applied not only to a club-head for an iron golf club, as in the foregoing embodiments, but also to a club-head for a putter.

Accordingly, the appended claims cover any such modifications which may incorporate those features which come within the true spirit and scope of the present invention.

I claim:

1. A club-head for a gold club made of metal comprising an outer shell which includes the striking face of the club head and is made of a first metal and a core body made of a second metal, said first metal having different specific weight from said second metal, said core body having a sole and a protrusion extending integrally and upwardly from said sole into said outer shell, said sole being exposed outside of substantially the whole bottom of said outer shell, said protrusion being embedded in said metal of said outer shell and having a size and upward extent such that the weight of said core body is concentrated at substantially the center of the hitting portion of said club head, said core body being integrally secured to said outer shell substantially by said embedded protrusion.

2. A club-head as defined by claim 1, wherein said core body is formed of a metal having a larger specific weight than that of said outer shell.

3. A club-head as defined by claim 1, wherein said core body is formed of a metal having a smaller specific weight than that of said outer shell.

* * * * *